US005775864A

United States Patent [19]

Maes

[11] Patent Number: 5,775,864

[45] Date of Patent: Jul. 7, 1998

[54] CLAMPING DEVICE FOR POSITIONING DOCUMENTS IN A THERMAL BINDING APPARATUS

[75] Inventor: Dirk Maes, Lokeren, Belgium

[73] Assignee: Esselte N.V., Sint Niklaas, Belgium

[21] Appl. No.: 784,525

[22] Filed: Jan. 17, 1997

[30] Foreign Application Priority Data

Jan. 23, 1996 [EP] European Pat. Off. ..... 96100879

[51] Int. Cl.[6] ..... B42F 3/00

[52] U.S. Cl. ..... 412/9; 412/37; 412/41; 412/902

[58] Field of Search ..... 412/9, 19, 37, 412/41, 902, 901

[56] References Cited

U.S. PATENT DOCUMENTS 3,407,105 10/1968 Staats et al. ..... 412/41
5,246,325 9/1993 Morishige et al. ..... 412/37 X
5,306,047 4/1994 Otalce et al. ..... 412/37 X
5,346,350 9/1994 Luhman et al. ..... 412/37

*Primary Examiner*—Willmon Fridie, Jr.
*Attorney, Agent, or Firm*—Jones, Tullar & Cooper, P.C.

[57] ABSTRACT

The present invention relates to a clamping device for positioning of a sheaf of documents during the heating and/or cooling phase in a thermal binding apparatus, whereby the thermal binding apparatus at its (upper) cover portion is provided with an opening which extents into the interior of the thermal binding apparatus and which consists of a base plate, two side walls and at least one front and/or rear wall. One of the clamping elements is provided having an at least partially curved surface, the clamping element is designed in such a way that clamping area of its curved surface is in contact with the sheaf of documents during the working phase and presses it against the rear and/or front wall of the opening and that it at least partly covers the base plate of the opening during the stand by phase of the binding apparatus.

15 Claims, 6 Drawing Sheets

CLAMPING DEVICE FOR POSITIONING DOCUMENTS IN A THERMAL BINDING APPARATUS

BACKGROUND OF THE INVENTION

The present invention relates to a clamping device for positioning a sheaf of documents during the heating and/or cooling phase of a thermal binding apparatus. The thermal binding apparatus at its upper cover portion is provided with an opening which extends into the interior of the thermal binding apparatus and consists of a base plate, two side walls and at least one front and/or rear wall.

There exist several methods for binding loose pages or documents together to a bound product. One of these methods is based on a heat-sealing or thermal process. In order to bind a sheaf of documents by means of this method, the sheaf of documents to be bound is inserted in a cover, whereby the spine of the cover is prepared inside with a hot-sealing adhesive. When the spine of the cover is in contact for a certain time with the heating plate, located at the bottom of the opening of the thermal binding apparatus, the adhesive begins to liquefy. The longitudinal edges of the pages or documents under the influence of gravity sink in the adhesive. During the hardening of the adhesive in the subsequent cooling phase the separate pages or documents are stuck together and to the cover.

In order to achieve good quality as regards the bound product, it is necessary during the heating phase—and preferably during the cooling phase—to hold the sheaf of documents in a fixed position in relation to the heating plate or cooling surface. Therefore thermal binding apparatuses are usually provided with a clamping device The clamping device has a further function: the heat of the heating plate, necessary for melting the adhesive, affects on the paper to be bound as well as on the transparent front side of the cover, which is usually made of PVC or other plastic materials. In particular when binding products of minor thickness, the lack of clamping elements would cause waving of the paper and deformation of the front side of the cover made of PVC.

In U.S. Pat. No. 4,141,000 the clamping device consists of two parallel plates forming the side walls of an opening over the heating plate. The rear plate is secured to the thermal binding apparatus, whereas the second, front plate is movable parallel to the first. After the sheaf of documents to be bound has been inserted, the second plate is pressed against the front of the sheaf of documents, whereby the sheaf of documents is urged together between the plates. As the second plate can be fixed in various positions in relation to the first plate, it is possible to hold the sheaf of documents in a determined position. The determined position is characterised in that the whole surface of the cover spine is in contact with the heating plate or the cooling surface.

The disadvantage of this solution is that for the clamping device, i.e. for the movable plate a considerable sophisticated mechanism is necessary, which means increased costs for material and production.

In U.S. Pat. No. 4,818,168 a further clamping device for supporting a sheaf of documents in a thermal binding apparatus is described. Here the clamping device consists of two flexible plates which on both sides extend into the interior of the opening and which have a V-like shape When inserting the sheaf of documents the plates are bent apart. Due to the fact that the plates are flexible the sheaf of documents is urged between the bottom edges of the plates.

The disadvantage of this solution is that the clamping range which is defined by the bottom edges, varies in accordance with the thickness of the documents to be bound. In view of the considerable variety of thicknesses the clamping range, optimal for a certain clamping process, can not always be guaranteed. The edges urging the sheaf of documents together can furthermore cause damage to the cover.

SUMMARY OF THE INVENTION

An object of the present invention is to provide a cost-effective clamping device, which makes it possible to produce high-quality products in a thermal binding apparatus.

For this purpose at least one clamping element is provided having an at least partially curved surface, the clamping element is designed in such a way that a clamping area of its curved surface is in contact with the sheaf of documents during the working phase and presses it against the rear and/or the front wall of the opening and that it at least partially covers the base plate of the opening during the stand-by phase of the binding apparatus.

According to a preferred embodiment of the present invention it is provided that the curve of the surface of the clamping area is designed in such a way that the clamping area—i.e. the area which is in contact with the sheaf of documents—is always in contact with the sheaf of documents in the determined area of the sheaf of documents, essentially independent of its thickness.

As already stated above, one of the two sides of the cover is usually made of transparent material, preferably PVC. This transparent area is adjacent to the spine of the cover. Respective tests shown that a slim area of the transparent cover adjacent to the seam of the two sides of the cover and the spine is especially easy to deformed during the heating phase. The extent of the deformation depends on the heating temperature, the binding time and the relation between the thickness of the sheaf of documents to be bound and the width of the spine of the cover to be used. The clamping device disclosed herewith is designed in such way that it always, independent of the thickness of the documents to be bound, has the optimal clamping effect in the predetermined critical area.

In an especially preferred embodiment of the present invention the clamping element is mounted to the opening of the thermal binding apparatus by a pivoting bearing and spring means. According to a favourable embodiment the pivoting bearing is mounted to the thermal binding apparatus in the area of the top edge of the clamping element. The clamping element is mounted to the thermal binding apparatus in a way that it extends into the interior of the opening and at the same time forms one of the rear or front walls of the opening. If there is no sheaf of documents in the opening, the clamping element due to spring tension is pressed against the opposite rear wall of the opening; in the stand-by phase the heating plate is thus covered by the clamping element. So on the one hand heat dissipation of the heating plate is presented, and on the other hand dirtying of the heating plate or of the cooling area is effectively avoided.

Instead of the pivoting bearing it is also possible to make the clamping element of a material, which in the stand-by phase is in contact with the opposite side of the opening and that as a result of its flexibility opens respectively when the sheaf of documents is inserted.

The clamping element—irrelevant of the construction details—is preferably made of heat-resistant material.

According to a further favourable embodiment of the present invention it is proposed that there is provided a mounting element for supporting a heating plate, whereby the heating plate forms the base area of the opening. The clamping element or the clamping elements is/are attached to the mounting element. The mounting element and the clamping element(s) can be produced by means of die-casting in a very cost-effective way.

A more cost-effective and therefore more preferable variant of the aforesaid embodiment provides that the clamping element consists of two side parts, which are connected by a center part. Alternative to this 'open' construction it is proposed that the center part covers the side parts. Here it is achieved that—as described in the aforesaid embodiments—that the heating plate or the base plate respectively in the opening are covered by the clamping element during the stand-by phase.

According to a further embodiment of the present invention it is provided that the clamping element consists of a bent wire, the center section of which is connected with the mounting element or with the heating plate and the endings of which have the form of bent wires. As in the previous described example the sheaf of documents is urged between the clamping elements, having now the form of bent wires, and the opposite side of the opening.

An advantageous development of this embodiment of the present invention is a. that the end sections of the bent wire are free, or b. that the end sections of the bent wire are connected by connection means whereby the connection means has guiding pins in its end sections, which are guided in respective guiding grooves by support means. These guiding pins are at the side walls of the heating plate or the mounting element. This construction is considered preferable with regard to stability.

For stabilising purposes of the sheaf of documents it is furthermore provided that the heating plate or the base plate respectively and at least one rear or front wall of the opening are inclined by a acute angle to the horizontal.

In an alternative embodiment of the present invention it is proposed that the clamping element has the form of a cylinder which preferably has the same length as the heating plate, i.e. the base area. In a combination with the described inclination of the heating plate and one of the rear or front wall, this embodiment also constitutes a cost-effective solution. In this case gravity is used in order to achieve a sufficient clamping effect.

BRIEF DESCRIPTION OF THE DRAWINGS

The present invention is described in more detail with the help of the following drawings.

DESCRIPTION OF THE PREFERRED EMBODIMENTS

Figure 1:
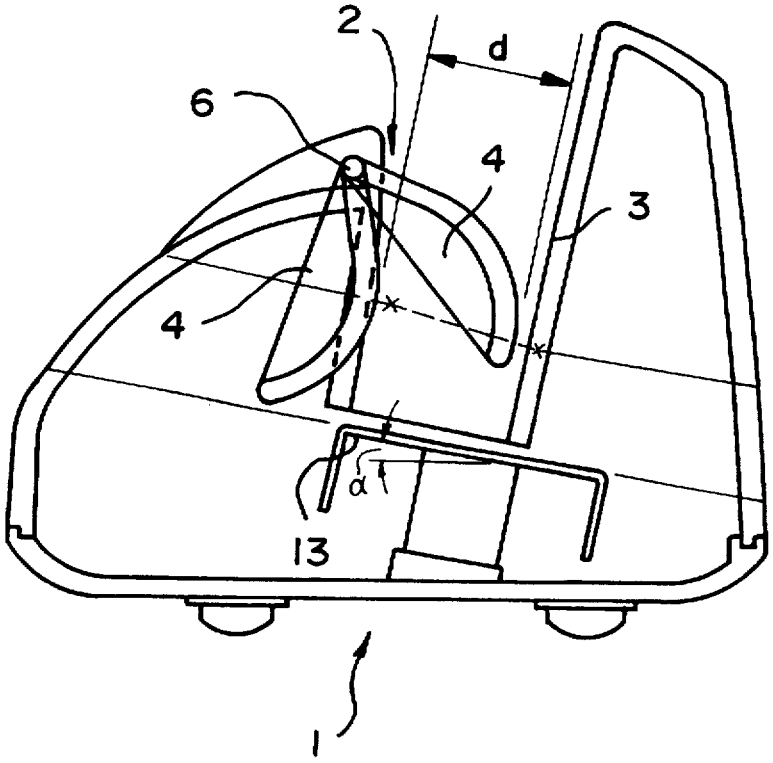
FIG. 1 is a cross-sectional view of a thermal binding device with a first embodiment of the clamping device according to the present invention.

FIG. 1 shows a cross-sectional view of a thermal binding apparatus 1 having a housing 1*a* including an opening 2, whereby in the opening 2 of the thermal binding apparatus 1 is shown the first embodiment of the clamping device. The opening 2 consists of a heating plate 13 forming the base plate 8, a rear wall 3 and two side walls. The heating plate 13, as well as the rear wall 3 of the opening 2 is inclined by an the angle $\alpha$ to the horizontal. Due to this construction, the sheaf of documents 10 is additionally stabilised in the opening 2.

It is possible to position in the opening 2 sheaves of documents having a certain thickness d. The maximal thickness dmax (FIG. 1*a*) of the sheaf of documents is determined by the maximal possible width of the opening. In order to make sure that sheaves of documents 10 of various thickness are always held in optimal position there is provided the clamping element 4. The clamping element 4 is in contact with the cover of the sheaf of documents in the range of a clamping area 7 defined on the front face of the clamping element 4, and presses the sheaf of documents against the rear wall 3 of the opening 2.

The clamping element 4 is pivotally mounted to the front part of the opening 2 by a pin 6. The clamping element 4 extends into the interior of the opening 2 and covers the heating plate 13. As soon as the sheaf of documents 10 is inserted in the opening 2 the clamping element 4 is moved from its resting position in accordance with the thickness of the sheaf of documents 10.

In order to mount the clamping element so that it exhibits springiness there are preferably provided two spring means 11 at the sides of the axis of rotation defined by the pin 6, which press the clamping area 7 of the clamping element 4 against the sheaf of documents 10 and the sheaf of documents 10 against the rear and/or front wall 3 of the opening 2. The spring means 11 are preferably wire springs which on both sides are plugged in to effect movement about the axis of rotation.

During the stand-by phase of the thermal binding apparatus 1 the clamping area 7 of the clamping element 4 is pressed against the rear wall 3 of the opening 2 and covers the heating plate 13 i.e. the base plate 8, which—as already mentioned above—can also constitute a resting plate for cooling the heated cover. Due to this there is on the one hand prevented dirtying of the heating plate 13 and on the other hand heat dissipation is avoided, what shortens the heating-up time of the heating plate to the temperature necessary for the subsequent binding process.

FIG. 1 shows that the clamping element 4 in all positions is the front wall of the opening 2. According to a preferred embodiment of the present invention the curve of the area of the clamping element 4 turned to the sheaf of documents 10 is furthermore constructed in a way that the respective clamping area 7 always is in contact with the sheaf of documents in the determined area of the sheaf of documents 10, essentially independent of its thickness. Thus it is guaranteed that the clamping element 4 gets in contact with the sheaf of documents 10 in an area above the spine of the cover, the area preferred in order to achieve an optimal binding result. This is shown in FIG. 1 by the two X's for the positions of the clamping element 4.

Figure 1A:
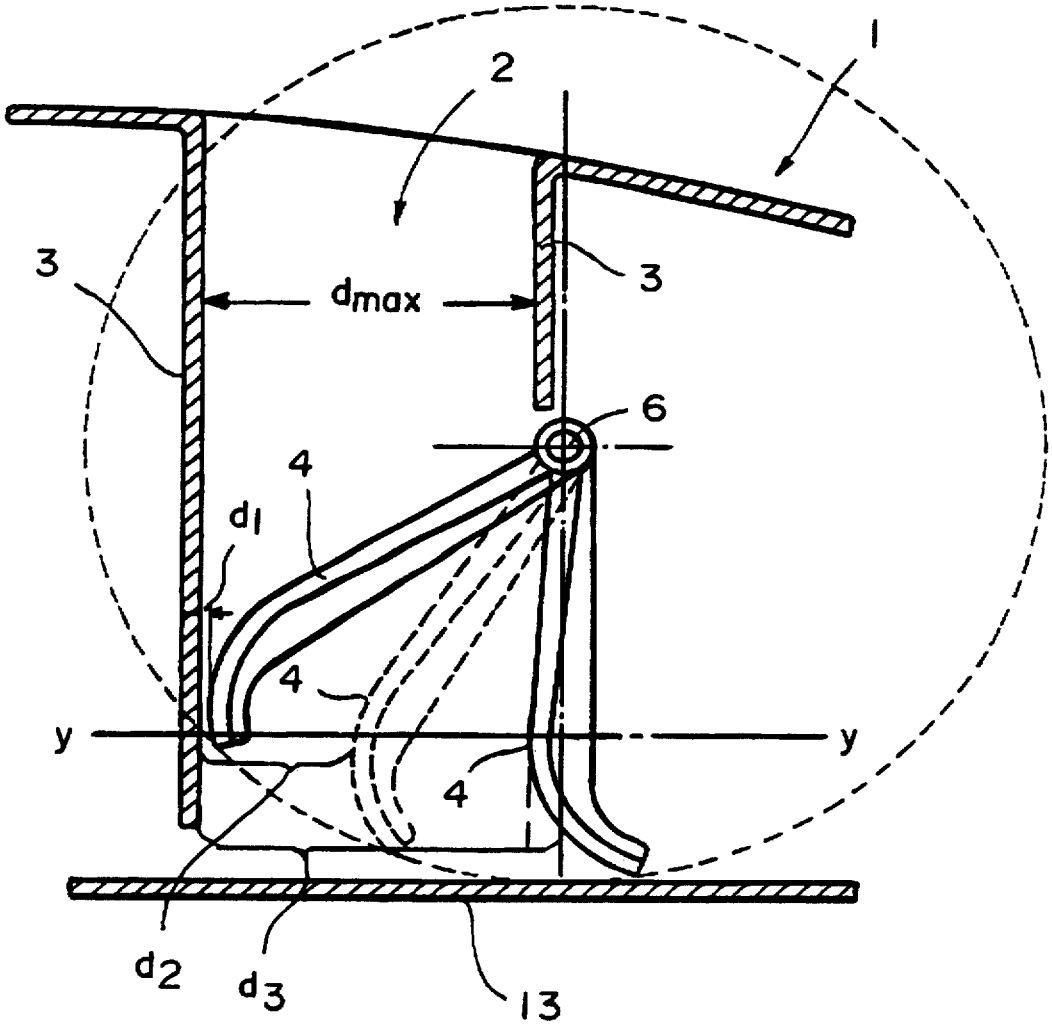
FIG. 1*a* is a cross-sectional view of a variant of the first embodiment of the clamping device according to the present invention.

According to FIG. 1 the clamping element 4 is mounted pivotally in the area of the top edge of the front wall 3 of the opening 2 and thus substitutes for the front wall of the opening 2. An alternative to this is shown in FIG. 1*a*. The clamping device is mounted not to the top edge of the opening, but in the interior of the opening. Thus the clamping element 4 here only partially substitutes for the front wall. FIG. 1*a* furthermore shows the curve of the surface of the clamping element 4 turned to the sheaf of documents 10. As already mentioned above the curve of the surface of the clamping area is designed in such a way that the clamping area—i.e. the area which is in contact with the sheaf of documents—is always in contact with the sheaf of documents in the determined area of the sheaf of documents and presses it against the rear wall—essentially independent of the thickness of the sheaf. This predetermined area (shown on FIG. 1*a* by the line Y—Y) is preferably over the seam between the transparent side of the cover and the spine.

Figure 2A:
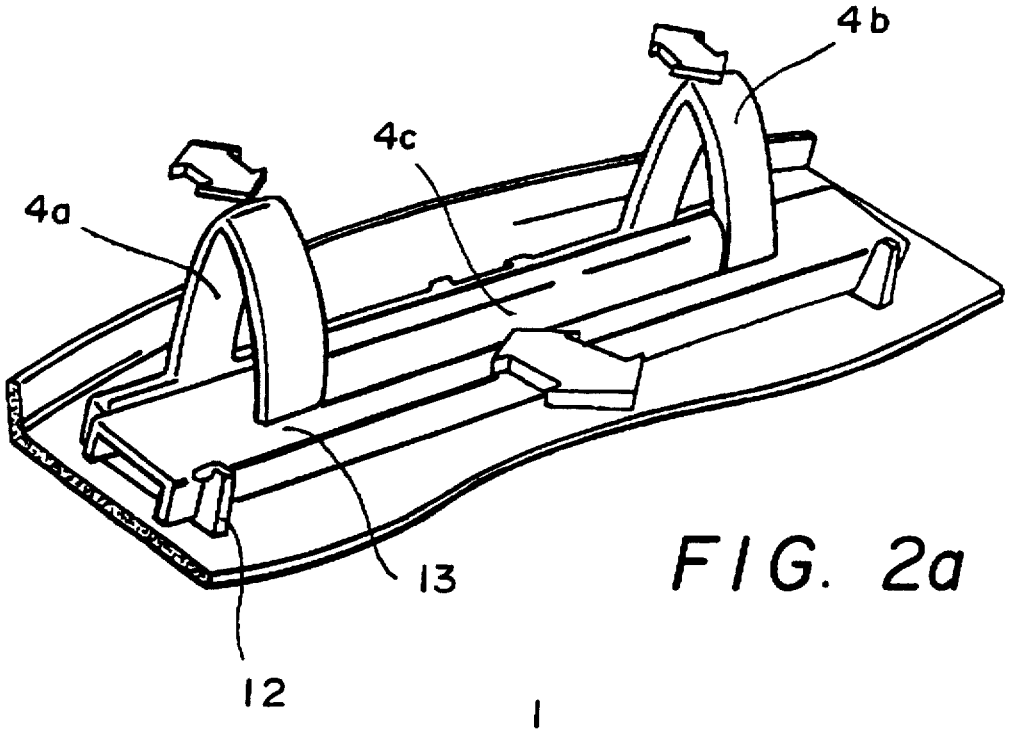
FIG. 2*a* is a perspective view of a second embodiment of the clamping device according to the present invention.

FIG. 2*a* is a perspective view of a second embodiment of the present invention. The clamping element 4 consists of two side parts 4*a*, 4*b*, which are connected by a center part 4*c*. The clamping device 4*a*, 4*b*, 4*c*, is part of the mounting element 12 of the heating plate 13. According to a preferred embodiment the mounting element 12 is made of an elastic material, i.e. PA (polyacitate) produced by means of die casting. The guide motion of the clamping device 4*a*, 4*b*, 4*c*, when the sheaf of documents 10 is inserted in or taken from the thermal binding apparatus 1 is shown by the arrows in FIG. 2.

Figure 2B:
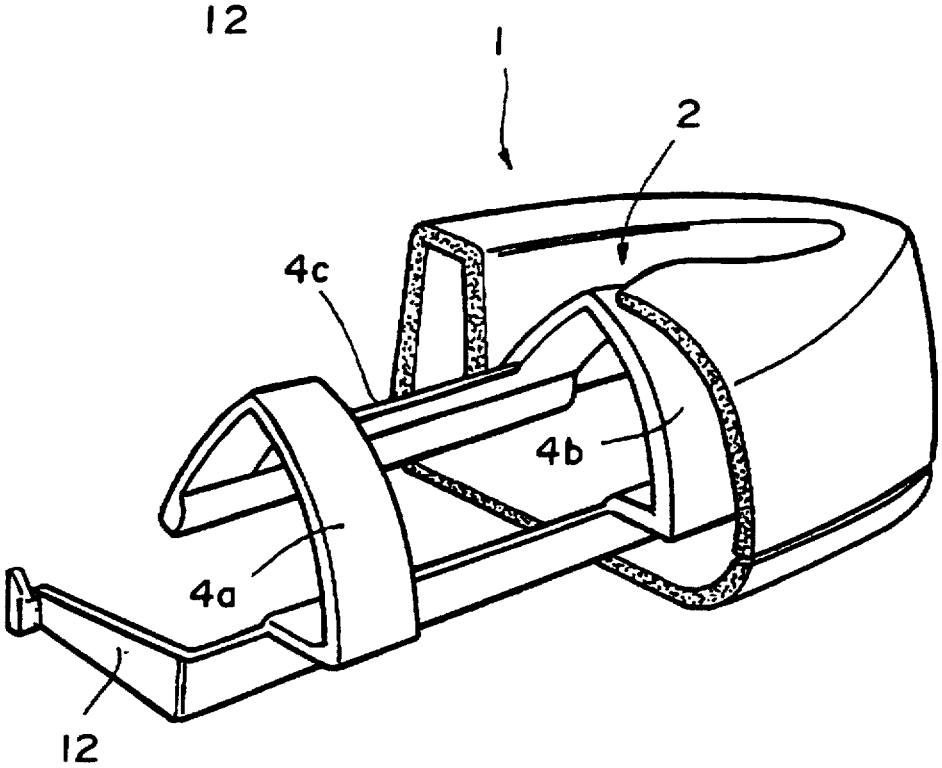
FIG. 2*b* is a perspective view as in FIG. 2*a* without the heating plate.

In FIG. 2*b* is the same embodiment as in FIG. 2*a* is shown but without the heating plate 13.

Figure 3:
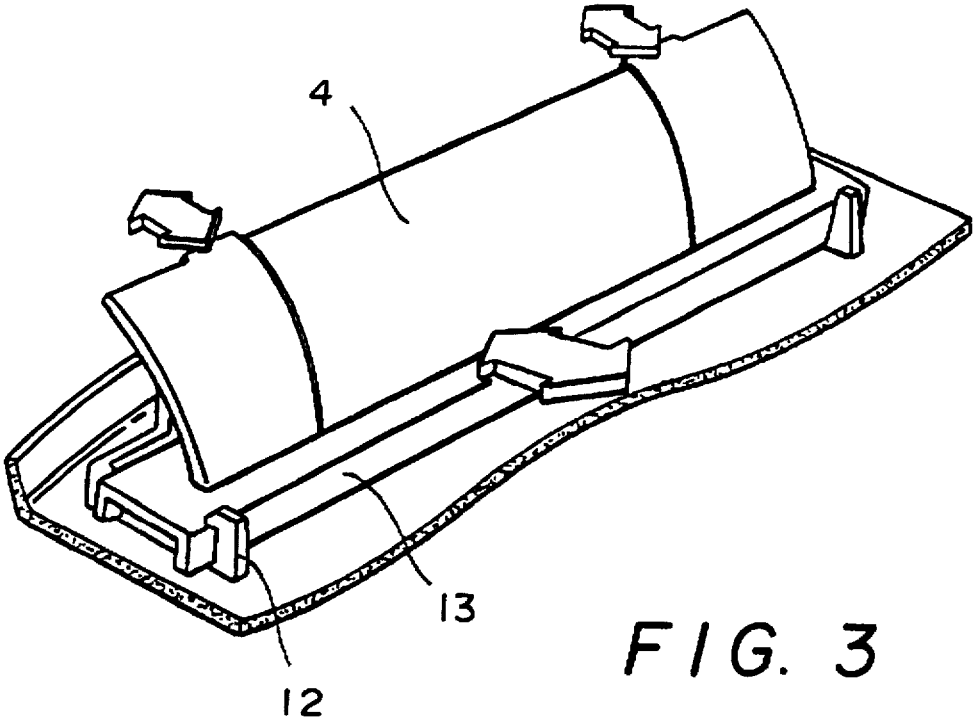
FIG. 3 is a variant on the embodiment shown in FIG. 2*a* and FIG. 2*b*.

FIG. 3 is a variant of the embodiment shown in FIG. 2*a* and FIG. 2*b*. The center part 4*c*, is substituted by a cover plate covering clamping elements 4*a*, 4*b*.

Figure 4:
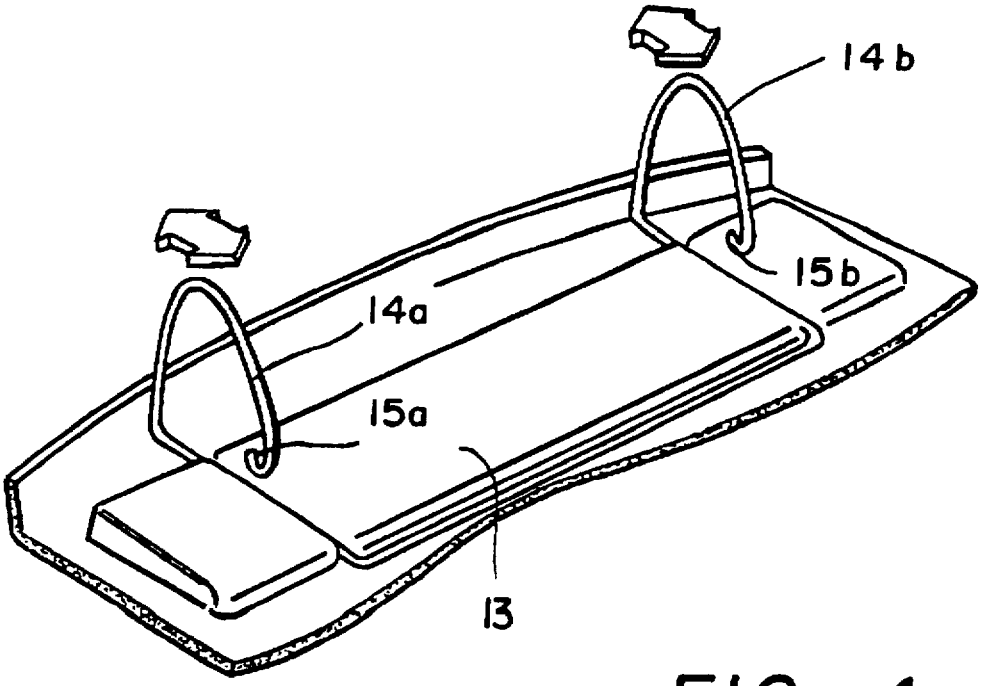
FIG. 4 is a perspective view of a third embodiment of the clamping device according to the present invention.

FIG. 4 is a perspective view of the third embodiment of the present invention. The sheaf of documents 10 is urged in the opening 2 by two laterally aligned bent wires 14*a*, 14*b*, the end sections of which are free. As the metal wires are elastic, it is possible to achieve an excellent clamping effect by means of this cost-effective solution. The guide motion of the clamping device is, as in FIG. 2, shown by arrows.

Figure 5A:
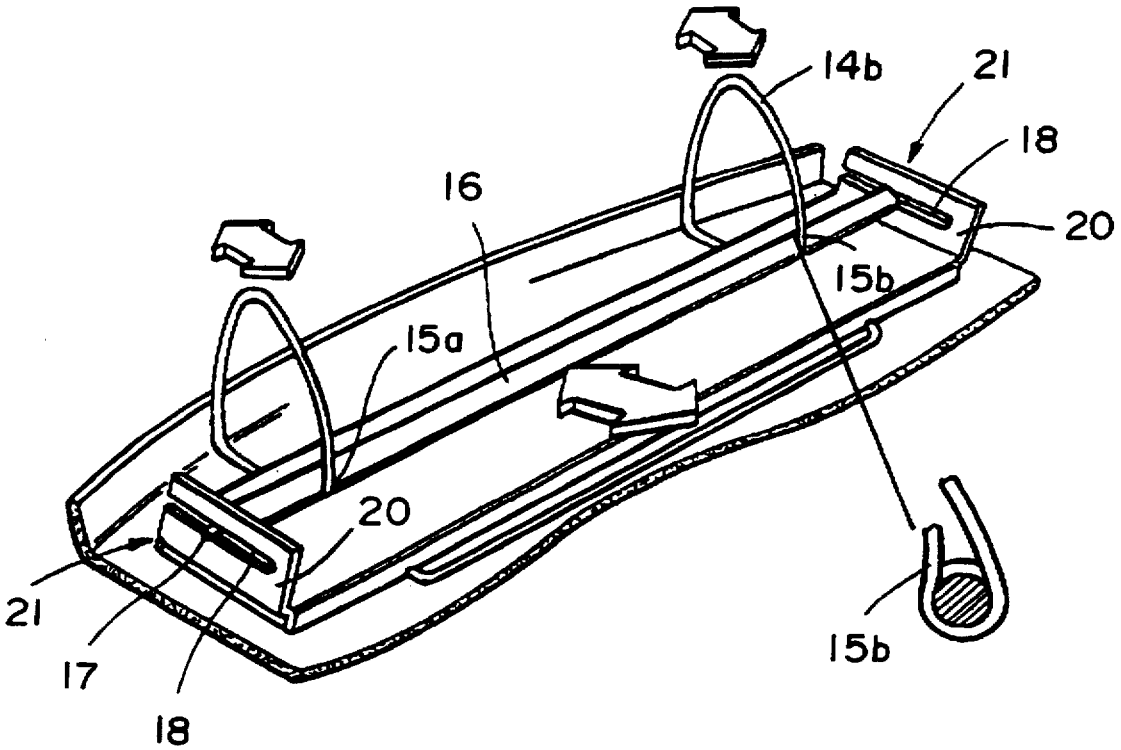
FIG. 5*a* is a perspective view of a fourth embodiment of the clamping device according to the present invention.

FIG. 5*a* is perspective view of the fourth embodiment of the present invention. The difference between this embodiment and the embodiment shown in FIG. 4 is that the end sections 15*a*, 15*b* of the bent wires 14*a*, 14*b*, are connected by a connection means 16. In the end sections of the connection means are attached guiding pins 17 which are supported with respective to guiding grooves 18. The guiding grooves 18 are provided in the elevated side wells 21 of the mounting element 12 or the heating plate 13. The guide motion of the clamping element 14*a*, 14*b*, and the connection means 16 again is shown by arrows.

Figure 5B:
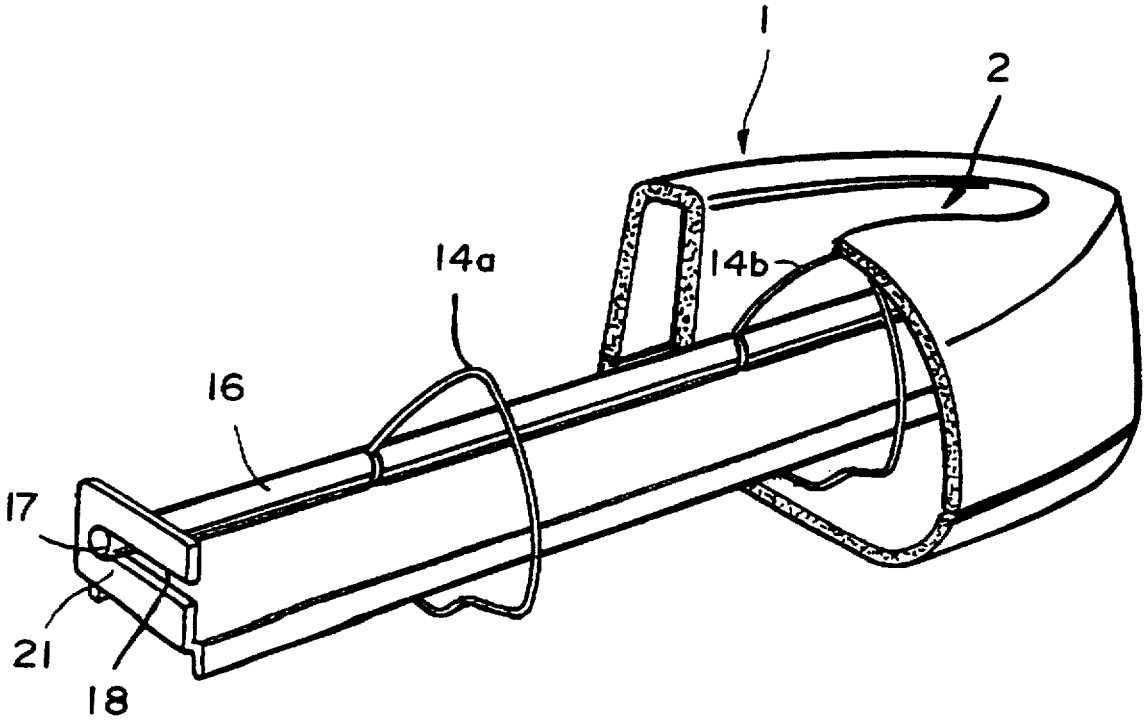
FIG. 5*b* shows the same embodiment as FIG. 5*a* being an integral component of the opening.

FIG. 5*b* shows the embodiment of FIG. 5*a* as an integral component of the opening 2.

Figure 6:
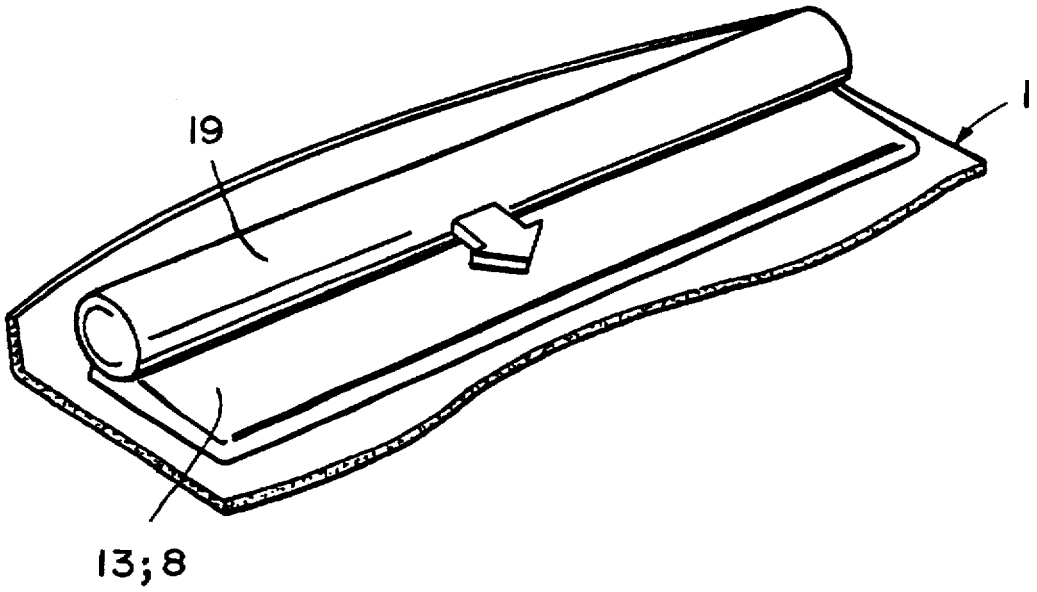
FIG. 6 is a perspective view of a fifth embodiment of the clamping device disclosed the present invention.

FIG. 6 is a perspective view of the fifth embodiment of the present invention. In this case the heating plate 13, as well as the rear wall 3 (not shown) of the opening is inclined by a the angle $\alpha$ to the horizontal. In this case the clamping element has the form of a cylinder, which due to gravity is in connection with the rear wall or the sheaf of documents 10.

I claim:

1. A clamping device for positioning a sheaf of documents in a thermal binding apparatus, the thermal binding apparatus having a working phase and a stand-by phase associated therewith and including a housing with a base plate, two spaced apart sidewalls and at least one of a rear wall and a front wall which together define an opening which extends into the thermal binding apparatus, said clamping device comprising: a clamping element having a curved surface defining a clamping area which contacts the sheaf of documents during the working phase of the thermal binding apparatus, said clamping element being mounted to said housing to at least partially cover the base plate during the stand-by phase of the thermal binding apparatus; and means for urging said clamping element, and consequently the sheaf of documents, against one of said front and rear walls during the working phase of the thermal binding apparatus.

2. The clamping device as defined in claim 1, wherein said clamping element is made of a heat-resistant, elastic material.

3. The clamping device as defined in claim 1, wherein said urging means comprises a pivoting bearing and spring means.

4. The clamping device as defined in claim 3, wherein said clamping element is made of a heat-resistant, elastic material.

5. The clamping device as defined in claim 1, wherein said clamping area is always in contact with a determined area of the sheaf of documents, essentially independent of the thickness of the sheaf of documents.

6. The clamping device as defined in claim 5, wherein said clamping element is made of a heat-resistant, elastic material.

7. The clamping device as defined in claim 6, wherein said urging means comprises a pivoting bearing and spring means.

8. The clamping device as defined in claim 1, wherein the base plate is formed as a heating plate, the thermal binding apparatus further having a mounting element for supporting the heating plate and said clamping element.

9. The clamping device as defined in claim 8, wherein said clamping element comprises two side parts connected by a center part.

10. The clamping device as defined in claim 9, wherein said center part covers said side parts.

11. The clamping device as defined in claim 9, wherein said two side parts consist of bent wires, and wherein said center part is connected with one of the thermal binding apparatus and the heating plate.

12. The clamping device as defined in claim 11, wherein the end sections of the bent wires are free.

13. The clamping device as defined in claim 12, the thermal binding apparatus further having connection means, including guide pins at its end section and spaced apart support means defining a guide groove which receive a respective one of said guide pins, said support means being provided as one of the side walls and the mounting element, and wherein the end sections of the bent wires are connected by said connection means.

14. The clamping device as defined in claim 1, wherein the base plate and at least one of the front and rear walls are inclined relative to the horizontal by an acute angle.

15. The clamping device as defined in claim 14, wherein said clamping element has a cylindrical shape, the length of which is substantially equal to the length of the base plate.

* * * * *